United States Patent [19]

Sano

[11] Patent Number: 4,714,416

[45] Date of Patent: Dec. 22, 1987

[54] QUIET RUNNING COMPRESSOR

[75] Inventor: Kiyoshi Sano, Shiga, Japan

[73] Assignee: Matsushita Electric Industrial Co., Ltd., Osaka, Japan

[21] Appl. No.: 758,076

[22] Filed: Jul. 23, 1985

[30] Foreign Application Priority Data

Jul. 26, 1984 [JP] Japan ..... 59-155825

[51] Int. Cl.[4] ..... F04C 18/344; F16K 15/16

[52] U.S. Cl. ..... 418/63; 418/270; 137/856

[58] Field of Search ..... 418/63, 270; 137/614.2, 137/614.16, 614.17, 855, 856, 513.3, 512, 857

[56] References Cited

U.S. PATENT DOCUMENTS

| | | | |
|---|---|---|---|
| 157,791 | 12/1874 | Cameron | 137/856 |
| 919,036 | 4/1909 | Langer | 137/512.1 |
| 976,010 | 11/1910 | Thompson | 137/512.1 |
| 1,356,298 | 10/1920 | McGregor | 137/512.1 |
| 2,247,520 | 7/1941 | Paxton | 137/512.1 |
| 2,296,492 | 9/1942 | Begley | 137/512.1 |
| 3,820,561 | 6/1974 | Papst | 137/512.2 |
| 3,857,652 | 12/1974 | Thayer | 417/312 |
| 4,427,351 | 1/1984 | Sano | 418/63 |

FOREIGN PATENT DOCUMENTS

| | | | |
|---|---|---|---|
| 53-36505 | 3/1978 | Japan . | |
| 833755 | 4/1960 | United Kingdom | 137/512.2 |
| 1140452 | 1/1969 | United Kingdom . | |

*Primary Examiner*—Carlton R. Croyle
*Assistant Examiner*—Jane E. Obee
*Attorney, Agent, or Firm*—Wenderoth, Lind & Ponack

[57] ABSTRACT

A compressor has a hermetic shell defining a compression chamber for compressing a fluid such as refrigerant gas supplied therein. The compressed gas is discharged from the compression chamber through a discharge port. A valve arrangement is provided at the discharge port for permitting the flow of the gas only in one direction from the inside to the outside of the compression chamber. The valve arrangement comprises first and second resilient elongated plates each having first and second ends. The first ends of the first and second elongated plates are rigidly connected to the hermetic shell and the second ends are placed one on top of the other over the discharge port. The second end of the first elongated plate on the discharged port is formed with at least one opening so that the pressurized gas discharged from the discharge port hits partly on the first plate and partly on the second plate through the opening. Accordingly, the vibration of discharge valves caused by the rapid change of amount of flow of refrigerant gas produced from the discharge port can be suppressed, resulting in a quiet running of compressor.

2 Claims, 7 Drawing Figures

QUIET RUNNING COMPRESSOR

BACKGROUND OF THE INVENTION

1. Field of the Invention

The present invention relates to a hermetic compressor for use in a cooling cycle system and, more particularly, to a quiet running compressor which has a simple cushion, or buffer, arrangement for absorbing very high pressure build-up in the discharge, or exhaust, system during the exhaust period of refrigerant.

2. Description for the Prior Art

According to the prior art, one type of a quiet running compressor is disclosed, for example, in U.S. Pat. No. 4,427,351 or British Pat. No. 1,140,452. In both of these patents, a space for cushioning the high pressure is provided on the exhaust side of the pump, thereby reducing the noise caused by the release of high pressure fluid through the discharge passage.

However, according to the prior art quiet running compressor as mentioned above, the space for cushioning the high pressure is located subsequent to a pressure applying space. Therefore, the top clearance of the compressor must be made large which deteriorates the compression efficiency.

Another type of quiet running compressor according to the prior art is disclosed, for example, in U.S. Pat. No. 3,857,652. According to this reference, the muffler for reducing the noise is located on the downstream side of the discharge valve. However, this arrangement has a problem in that extra space is required inside the compressor, resulting in a bulky compressor, and also, the noise reduction can not be done with a high degree of efficiency.

Yet another type of quiet running compressor according to the prior art is disclosed, for example, in Japanese Utility Model Laid-Open Publication (unexamined) No. 36505/1978. According to this reference, two discharge valves are provided, one over the other, for reducing the noise. However, the arrangement does not sufficiently suppress the vibration of discharge valves caused by the rapid change of amount of flow of refrigerant gas produced from the discharge port.

SUMMARY OF THE INVENTION

The present invention has been developed to substantially solve the above described disadvantage and has for its essential object to provide an improved quiet running compressor.

It is also an essential object of the present invention to provide a quiet running compressor of the above described type.

It is a further object of the present invention to provide a quiet running compressor.

A compressor has a hermetic shell defining a compression chamber therein for compressing a fluid such as refrigerant gas supplied therein. The compressed gas is discharged from the compression chamber through a discharge port formed therein. A valve arrangement is provided at the discharge port for permitting the flow of the gas only in one direction from the inside to the outside of the compression chamber. The valve arrangement according to the present invention comprises first and second resilient elongated plates each having first and second ends. The first ends of the first and second elongated plates are rigidly connected to the hermetic shell and the second ends thereof are placed in layers over the discharge port. The second end of the first elongated plate is directly placed on the discharged port and is formed with at least one opening so that the pressure gas discharged from the discharge port hits partly on the first plate and partly on the second plate through the opening. Accordingly, the vibration of discharge valves caused by the rapid change in the amount of refrigerant gas produced from the discharge port can be suppressed, resulting in a quiet running of compressor.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENTS

Figure 1:
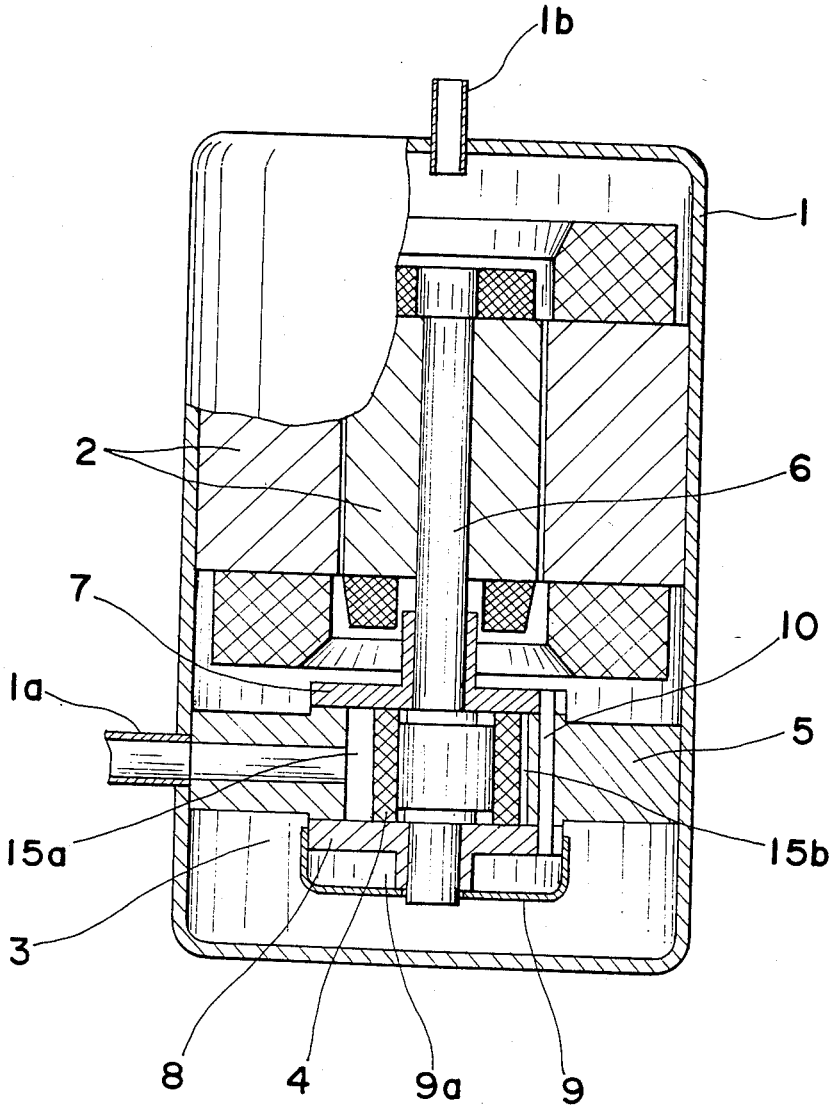
FIG. 1 is a cross-sectional view of a quiet running compressor according to the present invention.

Referring to FIG. 1, a quiet running compressor according to a preferred embodiment of the present invention is shown. The compressor shown comprises a hermetic casing 1 having a suction inlet tube 1*a* and a discharge outlet tube 1*b*. An electric motor 2 is firmly provided inside casing 1, and a compressor mechanism 3 is also provided inside casing 1 in association with motor 2.

Figure 2:
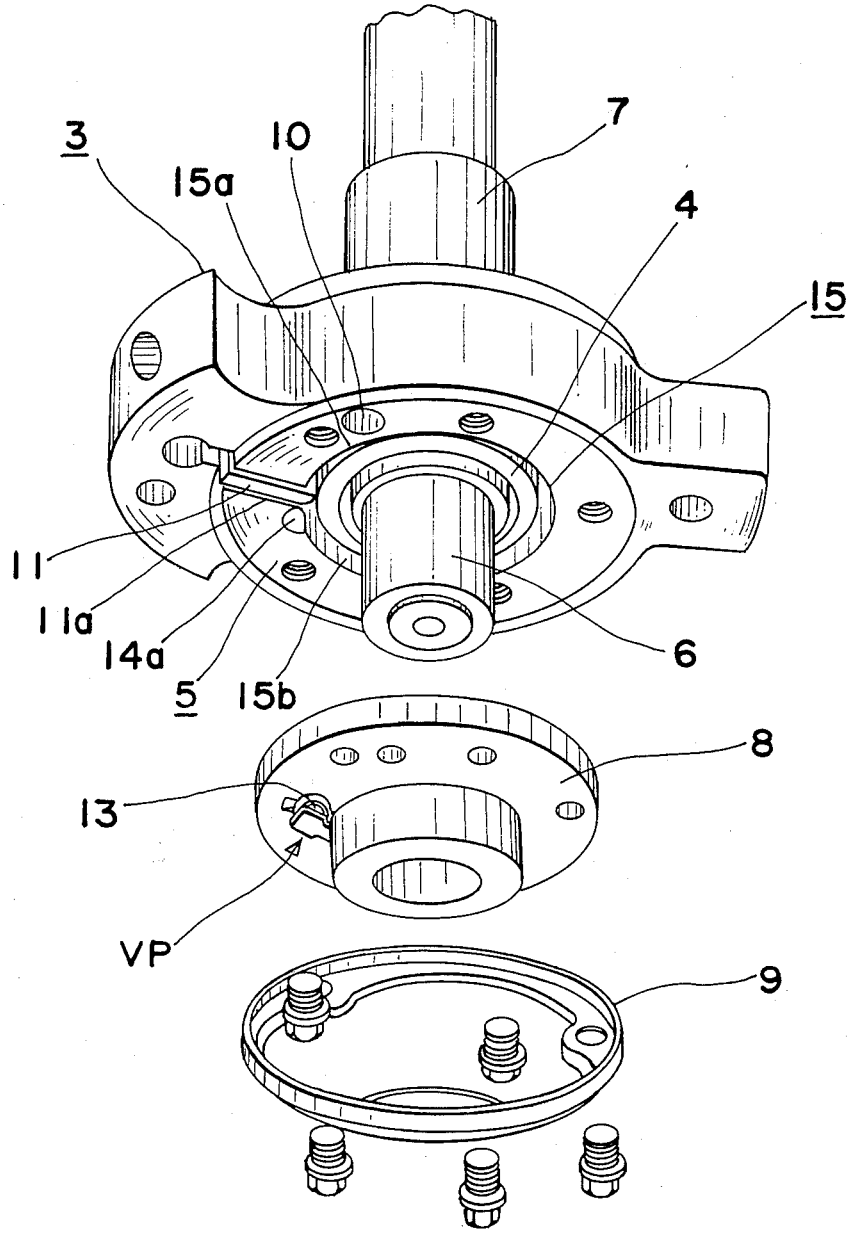
FIG. 2 is an exploded view showing the detail of compressor of the present invention.

Compressor mechanism 3 comprises a cylinder 5 having opposite ends thereof open, and a rotary piston 4 eccentrically mounted on a shaft 6 and accommodated inside cylinder 5. As shown in FIG. 2, cylinder 5 is formed with a groove 11*a* for slidably inserting a separation wall 11. One end of wall 11 extends into the chamber of cylinder 5 and the other end of wall 11 is located in the groove 11*a* and is connected to a suitable spring (not shown) so as to push the wall towards chamber of cylinder 5. Accordingly, the edge of the other end of wall 11 abuts against the curved surface of piston 4, thereby dividing the chamber into intake chamber 15*a* and compression chamber 15*b*. The opposite ends of cylinder 5 are hermetically closed by an upper bearing plate 7 and a lower bearing plate 8.

Mounted on the lower bearing plate 8 is a muffler shell 9 defining a muffler space 9*a* between plate 8 and shell 9. An discharge gas passage 10 is formed through cylinder 5 extending between muffler space 9*a* and the inside space of casing 1. Muffler space 9*a* is also connected to compression chamber 15*b* through a valve passage VP.

Figure 3:
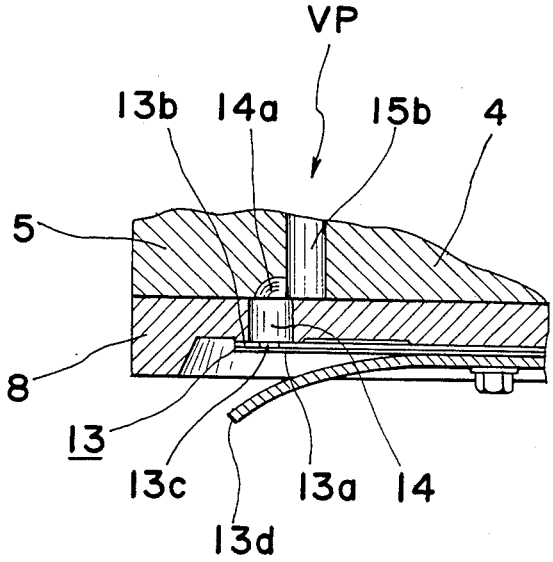
FIG. 3 is a fragmentary cross-sectional view showing a discharge passage portion with a discharge valve.
Figure 4:
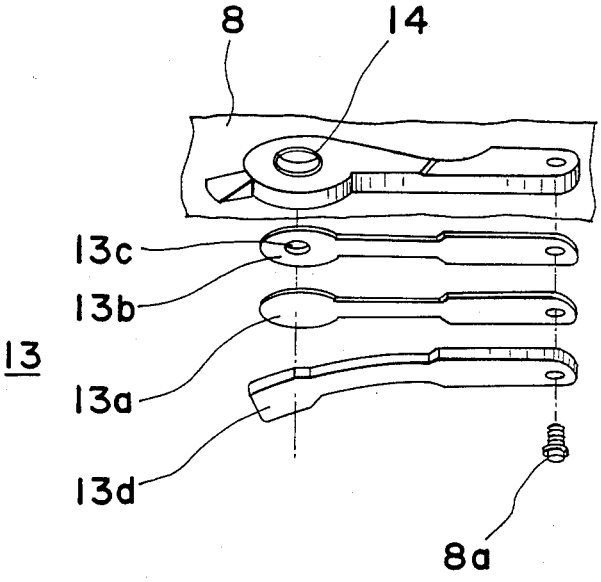
FIG. 4 is an exploded assembly view showing the detail of the discharge valve shown in FIG. 3.

As illustrated in FIG. 3, valve passage VP is defined by a quarter spherical recess 14a formed in cylinder 5 and located adjacent groove 11a for smoothing the flow of discharge gas, a discharge port 14 extending a discharge section of the compressor from recess 14a to muffler space 9a, and a valve arrangement 13 provided on the lower bearing plate 8 for permitting the gas flow only in one direction from compression chamber 15b to muffler space 9a.

Valve arrangement 13 comprises elongated plates 13a and 13b which are made of flexible thin steel sheet having a spring effect by the resilience thereof, and a stopper 13d made of a relatively thick steel plate. One end of each of the plates 13a and 13b and stopper 13d is formed with a small opening for fixedly attaching the plates 13a and 13b and stopper 13d to the bottom of lower bearing plate 8 by a securing screw 8a in said order. The other end of each of plates 13a and 13b and stopper 13d has a plane face sufficiently wide enough to cover the discharge port 14. Plate 13b has an opening 13c formed at the center of the plane face thereof. According to the preferred embodiment, a ratio of the area of opening 13c to the area of port 14 is between 0.05 to 0.4. Stopper 13d is arched to locate the end with the plate face away from the bottom of lower bearing plate 8. Thus, when the gas spouts from the discharge port 14, plates 13b and 13a will be blown down and will be held against stopper 13d.

Next, an operation of the quiet running compressor of the above described embodiment will be described.

When motor 2 is driven, piston 4 rotates. Thus, the refrigerant in a refrigerating system of a known construction is drawn through suction tube 1a into intake chamber 15a and, at the same time, the refrigerant filled in compression chamber 15b in the previous cycle is compressed and discharged through quarter spherical recess 14a and discharge port 14 into muffler space 9a. During the discharge, the pressure of the discharge gas pushes plates 13a and 13b towards stopper 13d. The refrigerant in muffler space 9a is then directed into the inside space of hermetic casing 1 through discharge gas passage 10 provided in cylinder 5 and is discharged further out through discharge tube 1b back into the refrigerating system.

When the compressed refrigerant gas spouts out from discharge port 14, pressure gas hits plates 13a and 13b which are then almost simultaneously raised from lower bearing plate 8 and which gradually lean on stopper 13d. However, since plate 13b has opening 13c aligned with the flow of gas from discharge port 14, such as with the center of discharge port 14, the movement of the plate 13b is not necessarily the same as that of plate 13a, but plates 13a and 13b are vibrated differently with respect to the spouting refrigerant gas. Therefore, with respect to an abrupt change in the amount of gas discharged from port 14, two plates 13a and 13b do not vibrate in a summed manner. As a result, the abrupt change in the amount of gas discharged from port 14 will not develop into a greater change, thereby suppressing the high pressure gas pulsation containing a high frequency component.

Also, since plate 13b has opening 13c, plate 13b will not undergo a large change in motion at the end of the discharge process with respect to the change of gas pressure at discharge port 14 and, therefore, the impact of plate 13b against a valve seat provided on lower bearing plate 8 around port 14 will be very small. Also, at the end of the discharge process, plate 13a comes into contact with plate 13b, but the impact between plates 13a and 13b will be very small due to the cushion effect of a lubricant oil film remaining on plate 13b. Then, when plates 13a and 13b are placed one over the other on discharge port 14, the two plates hermetically close discharge port 14.

Next, the description is directed to the noise characteristics of the compressor of the present invention.

Figure 5:
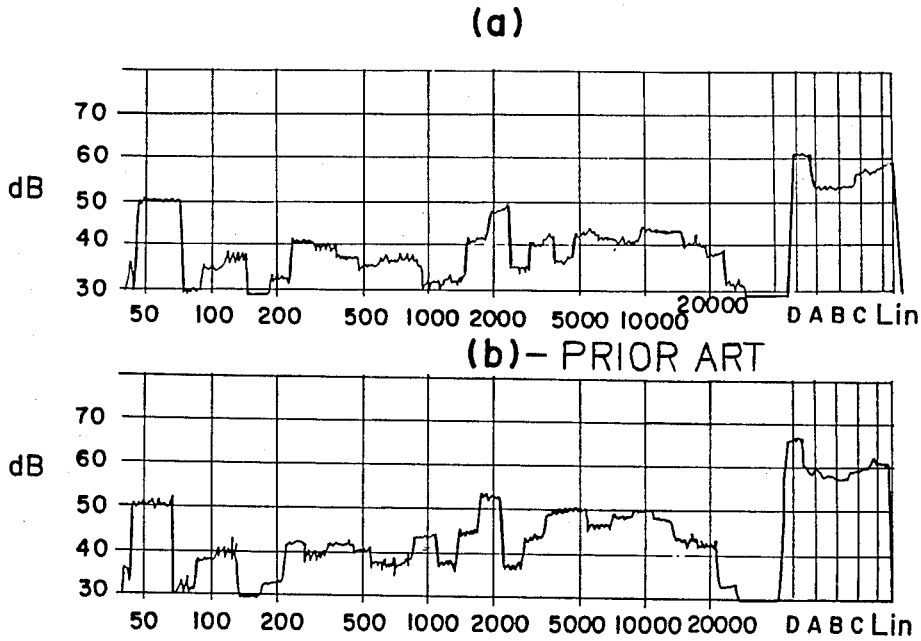
FIG. 5*a* is a graph showing a noise level at different frequencies according to the quiet running compressor of the present invention.
FIG. 5*b* is a graph similar to FIG. 5*a*, but particularly showing the noise level according to the prior art.

Compressors having an output power of 550W with a diameter of discharge port being 6.4 mm were tested. The test results of the compressor according to the present invention are shown in FIG. 5a, and the test results of the compressor of prior art is shown in FIG. 5b. The tests are carried out under conditions shown below.

Discharge pressure: $Pd=21.15$ Kg/cm$^2$
Suction pressure: $Ps=5.3$ Kg/cm$^2$
Temperature of suction gas: $Ts=18°$ C.
Rotating speed of piston: 3450 rpm Also, in the compressor according to the present invention, plates 13a and 13b have the same thickness as each other and are made of Sweden steel. The tests are carried out to obtain a distribution of noise in a range between 50 Hz to 20000 Hz. As understood from FIGS. 5a and 5b, the compressor according to the present invention generally showed lower noise level then that of the prior art.

By the number of tests, it has been found that a ratio of area S2 of opening 13c formed in plate 13b to area S1 of discharge port 14 has some influence on the noise reduction such that there exists a ratio S2/S1 at which the degree of reduction of noise is most outstanding. It is to be noted that the ratio S2/S1, at which the degree of reduction of noise is the most outstanding, may vary with respect to the change of thickness of plates 13a and 13b.

Figure 6:
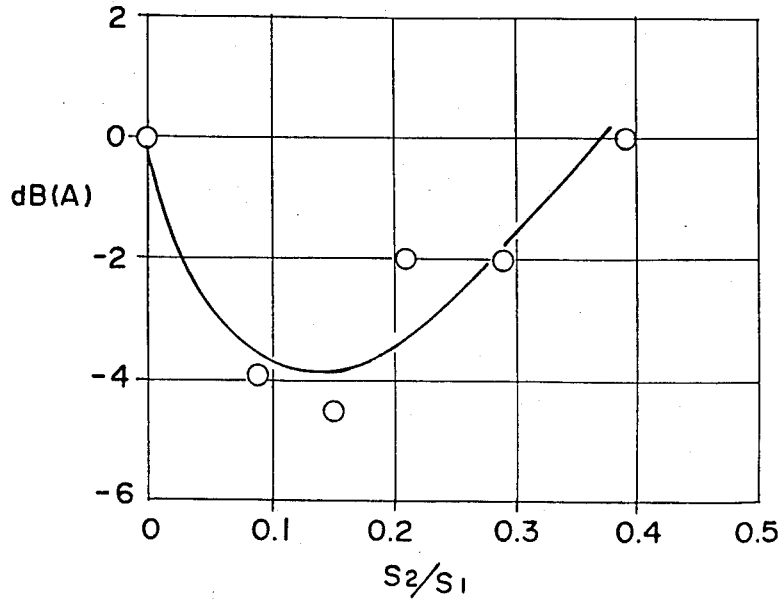
FIG. 6 is graph showing a change of noise reduction efficiency with respect to the change of ratio S2/S1 of an area of opening 13*c* to an area of opening 14.

Referring to FIG. 6, a graph is shown in which the abscissa and the ordinate represent the ratio S2/S1 and the degree of noise reduction, respectively. As understood from FIG. 6, the reasonable degree of noise reduction may be observed when the ratio S2/S1 is between about 0.05 and 0.3.

In the embodiment described above, valve arrangement 13 is described as defined by two flexible thin plates 13a and 13b, but may be defined by more than two flexible thin plates, in consideration of the output power of compressor and the diameter of the discharge port. Also the type of compressor can be any type so long as it has a valve arrangement 13.

Also, according to the preferred embodiment, opening 13c is formed at about the center of a round end of the plate 13b so as to be in alignment with the center of flow of the discharge gas. This arrangement has an advantage in strength with respect to the high pressure gas hitting the plate. However, according to the present invention, the number of openings formed in plate 13c may be more than one, and they may be located offset from the center of flow of discharge gas.

Furthermore, according to the present invention, the thickness of plates 13a and 13b may differ from each other. Ideally, plate 13a should be thicker than plate 13b.

As apparent from the foregoing description, the compressor according to the present invention shows a high noise reduction effect without deteriorating the compression efficiency, because there is no need to widen the top clearance of the compressor. Also, the noise reduction effect according to the present invention is accomplished simply by providing a number of plates with a hole formed in one of those plates. Therefore, the quiet running compressor according to the present invention can be manufactured in a relatively compact size at a low cost.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of the appended claims.

What is claimed is:

1. A valve arrangement for a compressor for compressing fluid, the compresor having a sealed casing having a suction inlet and a discharge outlet spaced from the suction inlet on the casing, a cylinder mounted within the casing and having an inlet opening extending radially therethrough open at one to and communicating with the suction inlet, a piston driven within the cylinder for drawing in fluid from the suction inlet and for compressing the drawn in fluid, and a discharge section having a discharge port extending therethrough having one end open to and communicating with the cylinder for allowing the compressed fluid to discharge therethrough to the discharge outlet, said valve arrangement comprising:

a first resilient plate having one end fixed relative to said cylinder and the other end positioned against said discharge section over the other end of the discharge port, said other end of said first resilient plate having a portion partially covering said discharge port and a hole extending therethrough coaxial with said discharge port, the ratio of the cross-sectional area of said hole to the cross-sectional area of said discharge port being between 0.05 and 0.3 for minimizing the force exerted by the compressed fluid discharged through said discharge port onto said other end of said first resilient plate thereby reducing noise associated with the contact of said other end of said first plate with said discharge section when said first plate is deflected away from said discharge section and off of said discharge port under the influence of said force; and a second resilient plate overlying said first resilient plate opposite said discharge port, said second resilient plate having one end fixed relative to said cylinder and the other end positioned against said other end of said first resilient plate and over said hole for covering said hole and said other end of said discharge port, said second resilient plate being deflected away from the discharge section by said force exerted by the compressed gas discharging through the discharge port to uncover said hole and the discharge port.

2. A valve arrangement as claimed in claim 1 and further comprising, a fixed stop positioned adjacent said first and second resilient plates opposite said discharge section for limiting the deflection of said second resilient plate when said second resilient plate is deflected by said force.

* * * * *